United States Patent [19]

Fiddler

[11] 4,028,512

[45] June 7, 1977

[54] LIQUID LEVEL ACTUATED ELECTRICAL SWITCH

[76] Inventor: Theodore E. Fiddler, 1268 Suffield Drive, Birmingham, Mich. 48008

[22] Filed: July 25, 1975

[21] Appl. No.: 599,132

[52] U.S. Cl. ..... 200/84 C

[51] Int. Cl.[2] ..... H01H 35/40

[58] Field of Search ..... 200/84 R, 84 C; 335/205–207; 340/59 C, 244 A; 73/308, 313

[56] References Cited

UNITED STATES PATENTS

| | | | |
|---|---|---|---|
| 1,244,962 | 10/1917 | Derby | 340/244 A |
| 1,783,448 | 12/1930 | Penn | 200/84 C |
| 1,935,029 | 11/1933 | Henning | 200/84 C |
| 2,973,415 | 2/1961 | Bryan | 200/84 R |
| 3,256,400 | 6/1966 | Wintriss | 335/207 |
| 3,260,815 | 7/1966 | Trimmer | 200/84 R |
| 3,931,485 | 1/1976 | Spielfidel et al. | 340/244 A |

*Primary Examiner*—David Smith, Jr.

*Attorney, Agent, or Firm*—William T. Sevald

[57] ABSTRACT

A liquid level signaling electrical switch operated by a float protected within a container in the tank being monitored for level so that only slow changes in level are allowed to influence the float position thereby substantially eliminating flickering of the signal lamp upon sudden changes in tank level at the float due to bump vibration, hill angulation, turns, and sudden starts and stops shifting the liquid in the tank off true gravational level. The float closes the switch at substantially true refill level by locating a magnet closer to an armature when the switch closes so that the magnet exerts strong magnetic force holding the switch closed thus also preventing flickering of the signal lamp. The float container and switch are integrated in a removable assembly together with a liquid supply tube, filter foot, and base connector so that complete assembly of parts is feasible outside the tank obviating separately installing parts in the tank.

1 Claim, 5 Drawing Figures

LIQUID LEVEL ACTUATED ELECTRICAL SWITCH

BACKGROUND OF THE INVENTION

The environment in which the invention is described as a windshield washer liquid reservoir tank for a vehicle and the invention may be used on any tank for any purpose. The devices of the prior art are complicated in design, construction, and operation; expensive to manufacture, assemble, repair, and replace; not desirably satisfactory in use; and inaccurate or unstable in signaling due to opening and closing the electrical contacts repeatedly when the liquid level is near a pre-selected point such as when refilling is indicated as desirable. The repetitious on-off condition causes the signal lamp to flicker thereby annoying and distracting the operator. In most prior art devices this flickering is occasioned by bouncing of the float resulting from vibration, the gravational effect on hills, and the centrifugal effect of turning and sudden starts and stops; all of which causes the liquid to rise and/or fall relative to the tank level which in turn causes the float to actuate the switch when the liquid level is not down to the refill point resulting in a false signal. The float thus is not protected against sudden changes in the actual liquid level at the float. Also the float does not have desirable buoyancy to render if effective with reliability such as in one case where the center of the float is removed for a guide pin. Another failure of the prior art devices is that they will jam in the "on" or "off" position giving a false indication of full or of needing a refill. It is recognized that the operator should be advised not to let the tank go dry not only to provide adequate liquid supply, but also to prevent the pump losing its prime and/or running dry and being damaged.

SUMMARY OF THE PRESENT INVENTION

With the foregoing in view, it is an object of the invention to provide a liquid level indicating device which is simple in design, construction, and operation; inexpensive to manufacture, assemble, repair, and replace; desirably satisfactory in use; and accurate and stable in signaling by substantially reducing and/or eliminating repeated opening and closing of the electrical contacts of the switch when the liquid level is adjacent the level pre-selected for signaling that refilling is desirable.

An object of the invention is to prevent flickering of the signal lamp to reduce annoyance and distraction for the operator and also to provide a more accurate indication of the actual level of the liquid at all times particularly when the liquid level is adjacent the refill point.

An object of the invention is to provide a protective container around the float inside the tank with relatively small orifices in communication with the liquid in the tank so that the liquid level in the container at the float is protected against sudden rise and fall conditions of the liquid in the tank due to hills, vibration, turning, and quick starts and stops; all of which cause the liquid in the tank to assume a position out of its normal gravational level which the device should indicate to the operator.

An object of the invention is to use the container as a smooth reliable guide for the float to insure that the float takes a true position at the actual level in the tank and/or container.

An object of the invention is to provide accurate and reliable switch operation so that when the liquid in the tank is above the refill level the switch is open and when at or below the refill level the switch is closed so that the operator will have a dependable signal.

An object of the invention is to provide a magnetic force bias on the switch when it is actuated by the float to the closed position to hold it in the closed position thereby eliminating flickering of the signal lamp.

An object of the invention is to prevent actual physical contact between the magnet and the armature to prevent lock-up between the magnet and armature so that when the tank is refilled the float may easily and reliably move the switch to the open position.

An object of the invention is to integrate a stand-pipe liquid supply tube in association with the protective container, float, switch, and a tank filler-hole closure member in a removable assembly so that the tank may be filled and refilled by removing the assembly, so that the tank itself may be inexpensively made without internal hard-to-get-at parts in the tank, and so that manufacturing and assembly is efficiently and inexpensively facilitated.

These and other objects of the invention will become apparent by reference to the detailed description of the illustrated embodiments of the invention taken in connection with the accompanying drawing.

DETAILED DESCRIPTION OF THE ILLUSTRATED EMBODIMENT

Figure 1:
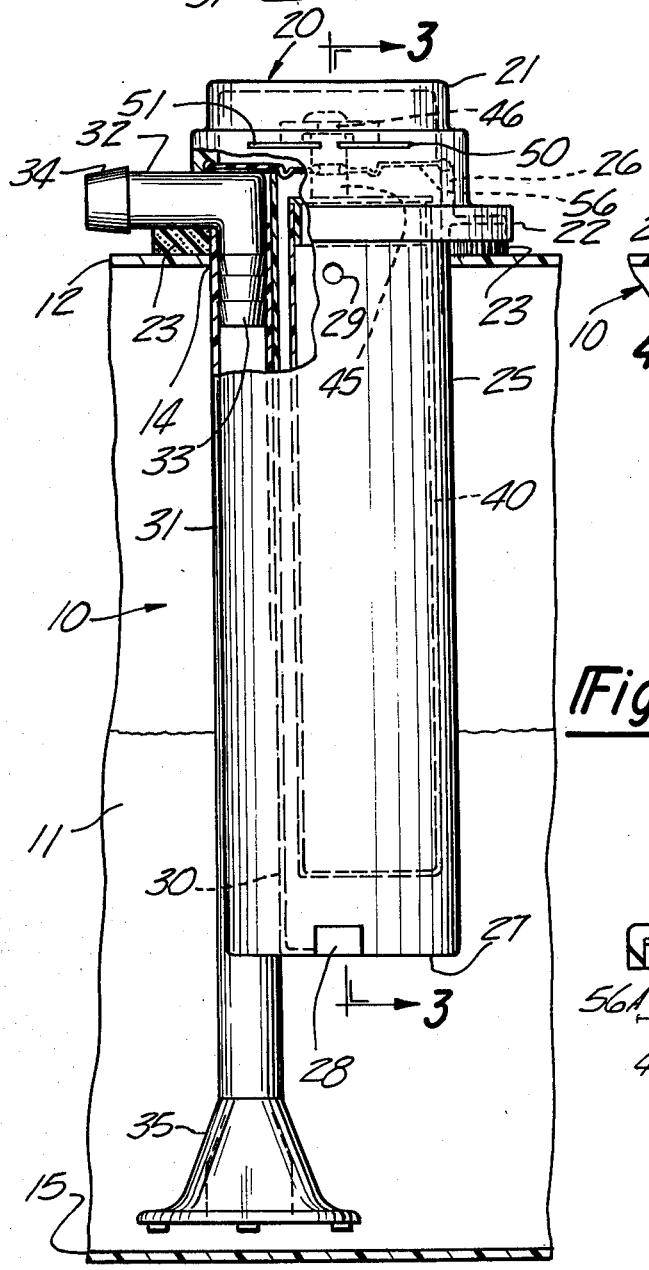
FIG. 1 is a general cross-sectional view of the device seen in FIG. 2, taken approximately on the line 1—1 thereof, showing the device mounted in a tank partly broken away and in cross-section, showing the supply tube and the float partly in elevation, and showing the switch parts in broken lines.
Figure 3:
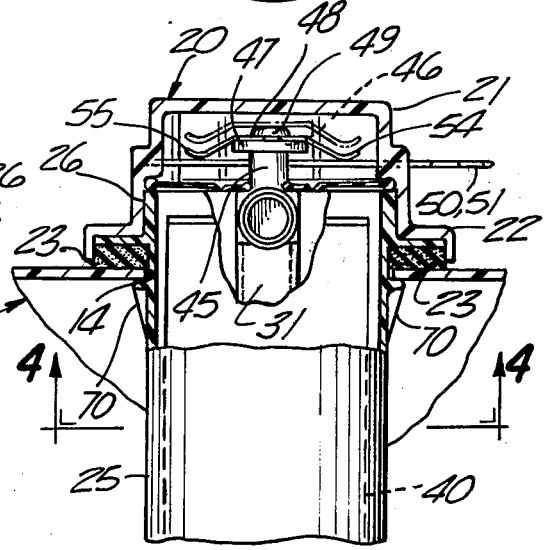
FIG. 3 is a cross-sectional view of the device seen in FIG. 1 taken on the line 3—3 thereof, showing on position of the switch bridge member in solid lines and the off position in dotted lines, and showing the container in elevation and broken away.

Referring now to the drawing wherein like reference numerals refer to like and corresponding parts throughout the several views, a tank 10 holds the liquid 11 and has a top 12 equipped with a filler-hole 14 and a bottom 15. FIG. 1. A switch assembly 20 has a hollow cap 21 with a flange 22 which fits over the tank filler-hole 14. A seal 23 lies between the cap flange 22 and the tank top 12. A container 25 has a top 26 bonded to the cap 21 and a bottom 27 depending into the tank 10. The container 25 has a small liquid communicating orifice 28 at the bottom 27 and a small vacuum-break pin-hole orifice 29 or other small passage adjacent the top 26. By virtue of the orifices 28 and 29 liquid flows slowly into and out of the container 25 and gradually seeks the same level in the container 25 as the liquid 11 in the tank. The orifices 28 and 29 are relatively small so that changes in the liquid level in the container 25 are delayed when the liquid level in the tank 10 changes suddenly at the container 25. The container 25 thus maintains a substantially stable liquid level and thus liquid in the container substantially escapes reaction to sudden changes in the liquid level of the tank 10.

A longitudinal arcuate indentation or cavity 30 is molded in the wall of the container 25. A supply tube 31 snaps into the cavity 30 and is spring-pressure held therein. An L-fitting 32 has an inner end 33 sealably inserted in the top of the tube 31 and an outer end 34 for connection with a hose leading to the pump, not shown. A filter foot 35 is sealably attached to the bottom of the tube 31 and provides an inlet to the tube 31 adjacent the bottom 15 of the tank 10.

Figure 2:
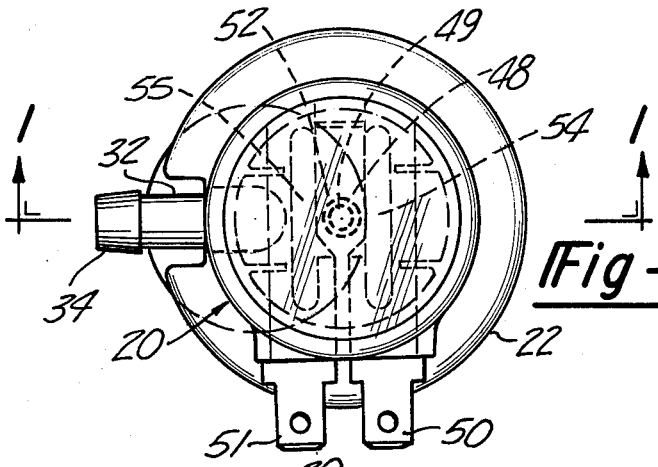
FIG. 2 is a top plan view of the switch and float assembly seen in FIG. 1 with the tank deleted and indicating internal parts in broken lines.
Figure 4:
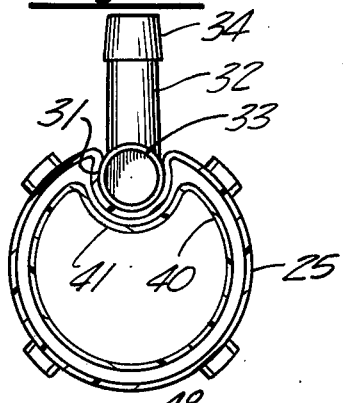
FIG. 4 is a cross-sectional view of the device seen in FIG. 3 taken on the line 4—4 thereof, with the tank deleted.

A float 40 lies inside the container 25. An inwardly extending longitudinal channel 41 is molded in the wall of the float 40. The channel 41 lies partially around the indentation of the cavity 30 in the container 25. FIG. 4. This provides the float 40 with a guide insuring non-angular movement of the float 40 in its up and down movement with the level of the liquid. This holds the switch parts in proper alignment as now described.

An upwardly extending rod 45 is mounted on the top of the float 40. A neck 46 surmounts the rod 45. A magnet 47 surrounds the neck 46 and rests on the rod 45. A bridge member 48 surrounds the neck 46 and lies on the magnet 47. A head 49 on the neck 46 overlies the bridge member 48. The head 49 is spun out of the portion of the neck 46 after the magnet 47 and member 48 are in place and secures them to the float 40 and prevents their angular and axial movement relative to the float 40. A pair of terminal strips 50 and 51 are embedded in the cap 21 below the bridge member 48 and have extending ends for connection to wires of the electrical circuit controlled. The terminal strips 50–51 lie on either side of the rod 45 and thus do not interfere with rise and fall of the float 40. The bridge member 48 comprises a central portion 52 attached to the rod 45 and radially extending spring contact fingers 54 and 55 overlying the terminal strips 50 and 51 respectively. As shown in the fingers 54 and 55 are shown as dual on each side of the central portion for making double and/or balancing contact with the terminal strips 50, 51. A diaphragm 56 lies between the cap 21 and the container 25, surrounds the rod 45 and seals off the switch parts thereabove from moisture in the tank 10 and container 25.

Figure 5:
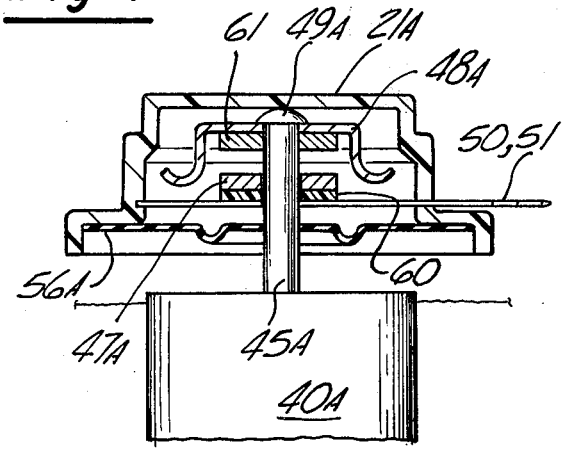
FIG. 5 is a view similar to FIG. 3 illustrating a modification of the switch parts with the float broken away and the tank and container removed.

Referring to the modifications of FIG. 5, the cap 21A supports the terminal strips 50, 51. An electrical insulator 60 freely surrounds the rod 45A and is mounted on the strips 50, 51. The magnet 47A also freely surrounds the rod 45A and is attached to the insulator 60. An armature 61 is mounted on the neck 46A under the bridge member 48A. The bridge member 48A and armature 61 are secured by the head 49A. A diaphragm 56A seals off the switch parts.

As shown and integrated, the terminal strips 50, 51 of FIGS. 1–4 are basically ferrous metal to react with the magnet 47; they may be copper coated. The armature 61 obviates the need for iron elements in the embodiment of FIG. 5.

In use and operation, FIGS. 1–4, with liquid in the tank above the pre-selected point for signaling to refill, the liquid in the container buoys the float 40 upwardly with the head 49 against the cap and the contact fingers 54, 55 above the terminal strips 50, 51 as indicated in the dotted line showing of their parts. The magnet 47 is thus elevated above the ferrous terminal strips 50, 51 so that the magnetic field is engaged in its weak outer limits. This is also true of the modification, FIG. 5, where the armature 61 is elevated above the magnet 47A and wherein the "full" condition of the parts when elevated is shown in solid lines.

As the liquid in the tank 10 is used, its level in the tank 10 goes down and the float 40 is lowered so that at the pre-selected and engineered liquid level, when it is desirable to advise that the tank 10 needs a refill, the float moves downwardly and engages the contact fingers 54, 55 of the bridge member 48 against the terminal strips 50, 51 closing the electrical circuit and illuminating the refill warning lamp and at the same time moves the magnet 47 into closer position to the armature 61 or the ferrous strips 50, 51 in a stronger part of the magnetic field whereat the magnet 47 and armature hold the spring contact fingers 54, 55 against the terminal strips 50, 51 preventing disassociation or repeated contact with resultant flickering of the signal lamp.

To refill the tank 10, the user removes the cap assembly 20 and pours liquid through the filler hole 14 of the tank. He then reinserts the cap assembly 20 into the hole 14 and presses down on it to force the tanges 70 on the container past the top 12 of the tank 10 whereupon the tanges 70 lock the assembly 20 and the tank 10 together. Upon the float 40 encountering the higher level of liquid in the refilled tank, it rises in the container 25 and lifts the spring contact fingers 54, 55 off the contact strips 50, 51 and moves the magnet 47 and armature 61 to relatively remote locations in the weaker outer area of the magnetic field. Due to the fact that the magnet and armature are never in physical contact, the float does not have to break a magnetic lock-up-between them to open the switch.

During vehicle operation of turning, starting, stopping, hill encounters, and vibration and bumps, the liquid in the tank can shift suddenly to a position of false level relative to the float is isolated against sudden level rise and fall by the fact that it is inside the container 25 which only allows slow true changes in liquid level to be communicated to the float via the small orifice 28.

While a preferred embodiment and a modification have been shown and described as exemplary of the invention, it will be understood that the scope of the claims is the only limitation on patent protection and it will be further understood that various other changes are covered by the scope of the claims.

I claim:

1. A normally open switch for closing a circuit to produce a signal voltage indicative of a condition, such as the liquid level in a tank, comprising, a float, means for movably mounting said float in a tank so that said float rises and falls with the level of the liquid in the tank, electrical terminals spaced apart and lying adjacent said float connectable to signal circuits, a bridge member for contacting said terminals to close a circuit between said terminals, a magnet mounted at one said terminal and said bridge member, an armature mounted at the other said terminal and said bridge member;

one said magnet and said armature being mounted for movement with said bridge member from a relatively remote position to a relatively proximate position relative to one another;

means connecting said float and said bridge member for moving said bridge member with said float responsive to the level of the liquid in a tank;

said float being capable of moving said bridge member toward said terminals from a relatively remote off position to an on position in contact with one another;

said magnet and said armature upon said terminals and said bridge member engaging one another in the on position, holding said bridge member and said terminals in contact with one another maintaining the on position to prevent flickering of the signal lamp;

a container enclosing said float; said container having at least one small orifice for communicating liquid from a tank to said container at said float; said container protecting said float against sudden changes in liquid levels in the tank at the float due to outside influences to prevent movement of the float to the on position when the liquid level of the tank is not at the true refill level;

a cap housing said switch parts; said cap being connected to said container enclosing said float; said cap and said container being attachable and removable relative to a tank;

said container having an arcuate longitudinal indentation forming a receiving socket; and a liquid supply tube nested in said socket and held in position therein by the spring-like force of the engagement; said container, cap and tube forming an assembly removably mountable in a hole in the tank as a unit; said supply tube leading to the bottom of a tank on which the assembly is mounted;

said indentation in said container lying adjacent to said float; said float having a channel receiving said indentation; said indentation and channel forming a guide for up and down movement of the float preventing angular movement of said float to maintain said electrical terminals and said bridge member in alignment.

* * * * *